US006202422B1

(12) United States Patent
Chazot et al.

(10) Patent No.: US 6,202,422 B1
(45) Date of Patent: Mar. 20, 2001

(54) JOULE-THOMSON COOLER

(75) Inventors: Dominique Chazot, Noyarey; Alain Cottereau, Grenoble, both of (FR)

(73) Assignee: L'Air Liquide, Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/384,595

(22) Filed: Aug. 27, 1999

(30) Foreign Application Priority Data

Aug. 27, 1998 (FR) ..... 98 10758

(51) Int. Cl.[7] ..... F17C 7/02
(52) U.S. Cl. ..... 62/51.2
(58) Field of Search ..... 62/51.2

(56) References Cited

U.S. PATENT DOCUMENTS 2,455,298 11/1948 Cahenzli, Jr. .
2,991,633 * 7/1961 Simon ..... 62/514
3,048,021 8/1962 Coles et al. .
4,781,033 11/1988 Steyert et al. .

FOREIGN PATENT DOCUMENTS 0 349 933 1/1990 (EP) .
2 611 870 9/1988 (FR) .
1168997 10/1969 (GB) .
WO 98/26236 6/1998 (WO) .

* cited by examiner

*Primary Examiner*—Corrine McDermott
*Assistant Examiner*—Malik N. Drake
(74) *Attorney, Agent, or Firm*—Young & Thompson

(57) ABSTRACT

The Joule-Thomson cooler comprises a low-pressure circuit (2) in a spiral, flat, cylindrical or conical shape, formed in a block (1) of insulating material, and a high-pressure circuit comprising at least one, typically two, branches (4*a*, 4*b*) communicating with a central expansion orifice (6) , each branch itself being wound into a helical spiral, the two branches being produced in the form of cylindrical spirals of opposite hand so that they can nestle together in the duct (2) . The cooler is particularly applicable to photodetector devices with infrared-sensitive elements (9).

8 Claims, 2 Drawing Sheets

JOULE-THOMSON COOLER

FIELD OF THE INVENTION

The present invention relates to Joule-Thomson coolers of the type comprising a low-pressure gas circuit and a high-pressure gas circuit arranged in the low-pressure gas circuit and having an expansion orifice.

BACKGROUND OF THE INVENTION

Joule-Thomson coolers of this type are described, in particular, in documents EP-A-258,093 (L'AIR LIQUIDE), FR-A-2,590,357 (SAT) or EP-A-349,933 (LICENTIA). Although the known devices of this type can be produced in a particularly compact shape, this is generally at the expense of having mediocre thermodynamic performance.

SUMMARY OF THE INVENTION

The object of the present invention is to provide a Joule-Thomson cooler which, for a very low cost of manufacture and in a particularly compact and robust form, is able to offer acceptable and reproducible performance.

To achieve this, according to one characteristic of the invention, the high-pressure gas circuit comprises a first and a second branch, both opening into the expansion orifice and produced in the form of helical spirals of opposite hand nestled together and arranged in a duct which, at least in part, forms the high-pressure circuit.

BRIEF DESCRIPTION OF THE DRAWINGS

Other features and advantages of the present invention will emerge from the following description of one embodiment, which is given by way of entirely non-limiting illustration, in conjunction with the appended drawings, in which.

DETAILED DESCRIPTION OF THE INVENTION

Figure 1:
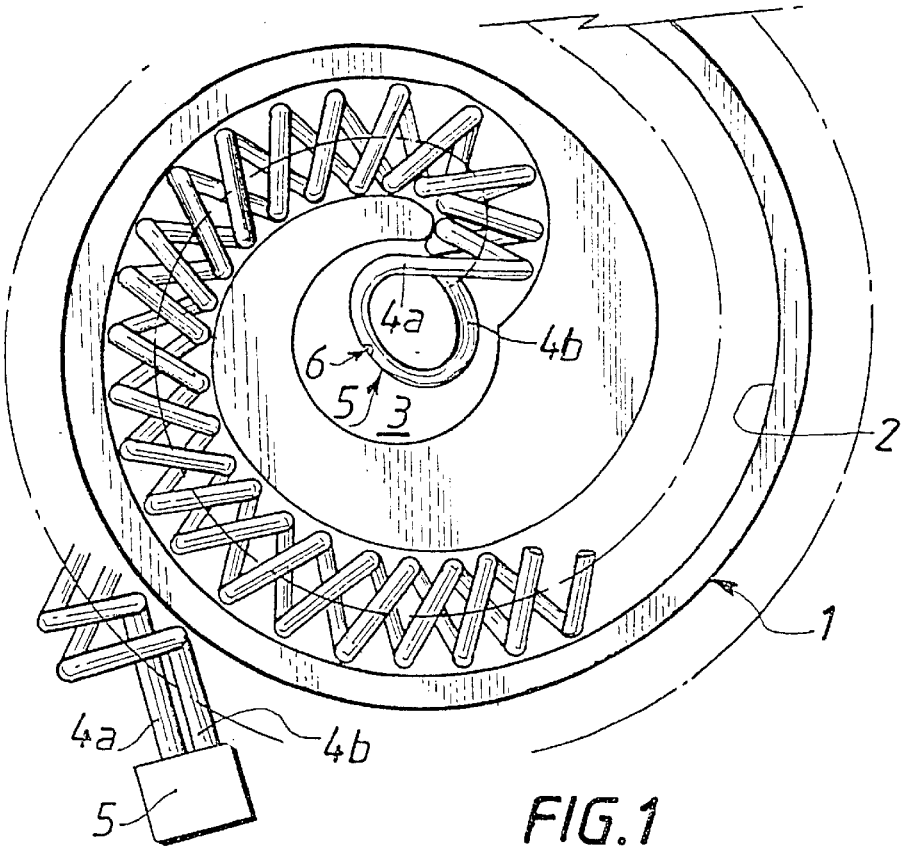
FIG. 1 is a diagrammatic part view, from above, of a first embodiment of a Joule-Thomson cooler according to the invention.

In the description which will follow and in the drawings, elements which are identical or similar bear the same reference numerals, possibly with a suffix.

Figure 2:
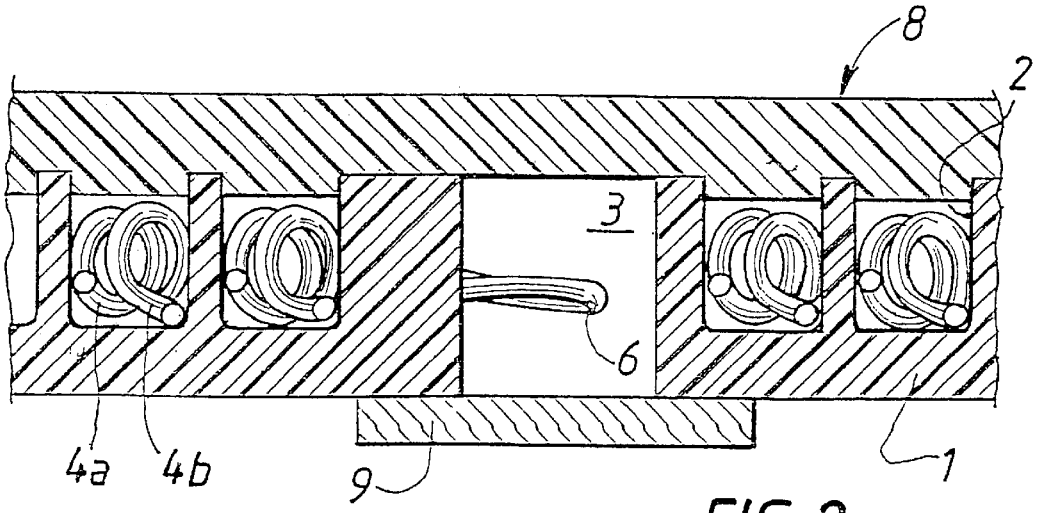
FIG. 2 is a diagrammatic part view in cross section of the cooler of FIG. 1.

FIGS. 1 and 2 depict a body or block 1 made of insulating material, in the overall shape of a disc in which a spiral-shaped channel 2 of roughly rectangular cross section, typically of U-shaped channel section, is formed. In the embodiment of FIGS. 1 and 2, the channel 2 runs in a spiral converging towards a chamber 3 formed centrally in the block 1.

Arranged in the channel 2 is a high-pressure circuit for conveying a refrigerant intended to be expanded to generate cold. The high-pressure circuit, formed of a metal tube, for example made of stainless steel, with an inside diameter of, for example, the order of 0.30 to 0.40 mm, consists of at least one branch, typically of two branches 4*a*, 4*b*, extending in parallel from a high-pressure coupling 5 intended for coupling to a source of high-pressure gas (not depicted), such as nitrogen or argon and which, in the chamber 3, meet at a common central part where an orifice 6 is formed for expanding the high-pressure gas conveyed along the branches 4*a* and 4*b*.

According to the invention, each branch 4*a*, 4*b* is itself wound into a cylindrical helical spiral, the branches 4*a* and 4*b* being spiral wound with opposite hand so that they can nestle together, as is clearly visible in FIG. 1, occupying the spiral-shaped space of the channel 2 as best possible, and thus making the assembly relatively insensitive to knocks and/or vibrations. This technology also makes it possible to have a long length of high-pressure circuit in a small amount of space, and thus provide the maximum possible area for heat exchange with the low-pressure gas expanded at 6 and travelling back along the channel 2 from the central chamber 3 to a peripheral outlet 7 in FIG. 3, the nestled double-helix shape of the branches 4*a*, 4*b* forcing the low-pressure gas running through the channel 2 to be highly turbulent, thus ncouraging the maximum heat exchange.

Losses by thermal conduction to the outside are minimized by virtue of the thermally insulating nature of the block 1, advantageously made of a composite material, such as fibreglass, or of a plastic such as a vessel, produced by injection moulding or machining, the channel 2 being closed via a cover 8, itself made of an insulating material mounted, for example bonded or thermally welded, on the block in such a way as to close the open side of the channel section forming the spiral-shaped channel 2.

A Joule-Thomson cooler of this type finds a main application in the cooling of photodetector devices, particularly for infrared sight. Typically, for such an application,- an infrared detector element 9 is mounted on the body 1 directly facing the chamber 3, on the opposite side to the cover 8, the expansion orifice 6 advantageously opening towards the element 9. With the above-described geometry, the assembly equipped with the body 1 and with the cover 8 has an overall diameter which is able not to exceed 30 mm, for a thickness of 8 mm.

Figure 3:
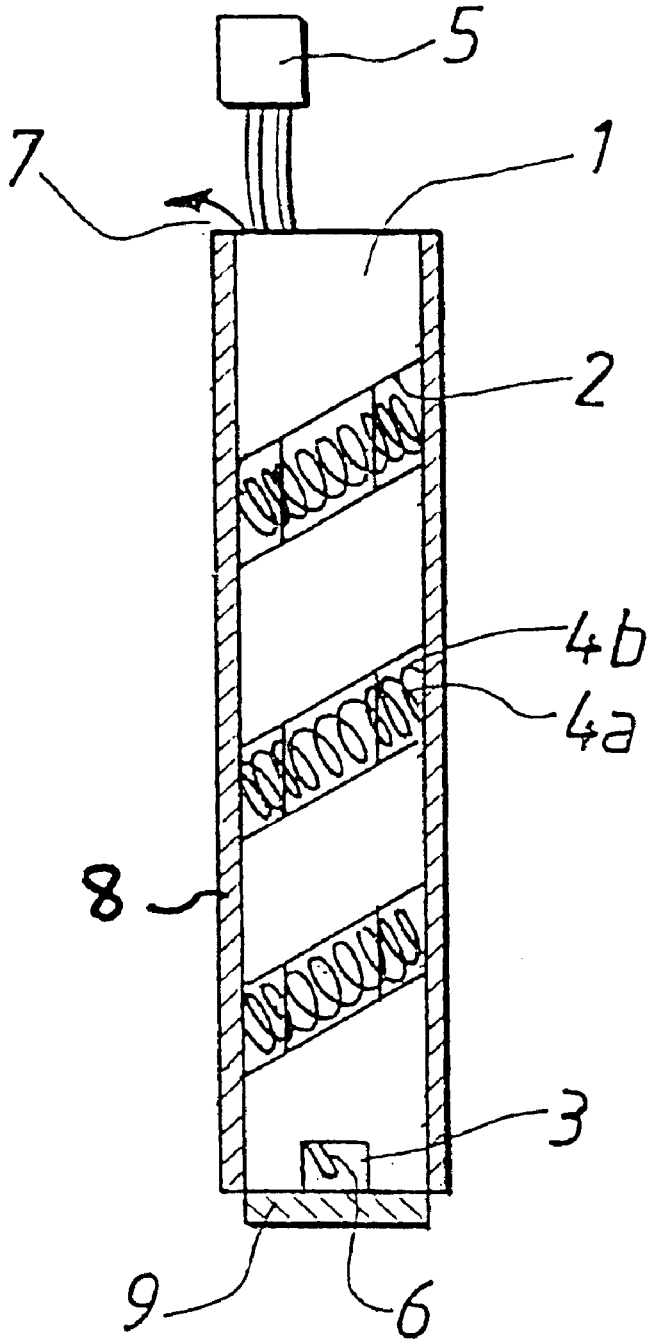
FIG. 3 is a diagrammatic view in longitudinal section of a second embodiment of a Joule-Thomson cooler according to the invention.

In the embodiment of FIG. 3, the support block 1 has the overall shape of a cylindrical bar. The duct 2 in the form of an off-axis U-shaped section, here follows a helical path around the bar 1 between an access opening (not depicted) at the same end as the high-pressure coupling 5, and the chamber 3 which, in this instance, lies in the front face of the bar 1 at the opposite end to the coupling 5. The cover 8 which closes the channel 2 and insulates it from the outside is, in this instance, produced in the form of a cylindrical shell made of insulating thermoplastic material push-fitted onto the bar 1.

Although the present invention has been described in conjunction with specific embodiments, it is not restricted thereto but, on the contrary, can be modified and altered in ways which will be obvious to person skilled in the art. Thus, the channel 2 may, as appropriate, be produced in the form of a conical helix converging towards the chamber 3.

What is claimed is:

1. A Joule-Thomson cooler, comprising a low-pressure gas circuit and a high-pressure gas circuit extending in the low-pressure gas circuit, the high-pressure gas circuit having one end connectable to a source of gas under pressure and a gas expansion orifice at another end, the high-pressure gas circuit comprising a first and a second branch, both opening into the expansion orifice and shaped in the form of helical spirals of opposite hand nested together, the high-pressure circuit being defined at least in part by a duct formed in a body.

2. The Joule-Thomson cooler of claim 1, wherein the body is made of a block of heat insulating material.

3. The Joule-Thomson cooler of claim 2, wherein the duct terminates at one end into a chamber formed in the block where the expansion orifice of the high-pressure gas circuit opens.

4. The Joule-Thomson cooler of claim 3, wherein the duct has a substantially U-shaped cross section with an open side closed by a wall of insulating material mounted on the body.

5. The Joule-Thomson cooler of claim 3, wherein the duct has a spiral of helical overall configuration.

6. The Joule-Thomson cooler of claim 3, further comprising an outer member mounted on the block and closing the chamber.

7. The Joule-Thomson cooler of claim 6, wherein the outer member is a detector support.

8. The Joule-Thomson cooler of claim 1, wherein the duct has a spiral of helical overall configuration.

* * * * *